United States Patent [19]

Handelman

[11] Patent Number: 4,843,662

[45] Date of Patent: Jul. 4, 1989

[54] TWO PERSON SEAT CASE

[75] Inventor: Robert I. Handelman, Chicago, Ill.

[73] Assignee: KR Industries, Inc., Chicago, Ill.

[21] Appl. No.: 191,561

[22] Filed: May 9, 1988

[51] Int. Cl.[4] ..... A47C 27/14

[52] U.S. Cl. ..... 5/481; 5/448; 5/420; 5/470; 297/DIG. 1

[58] Field of Search ..... 5/432, 437, 462, 465, 5/466, 470, 481, 490, 433, 420; 297/DIG. 1; D6/356, 595, 596, 601, 611

[56] References Cited

U.S. PATENT DOCUMENTS

| | | | |
|---|---|---|---|
| D. 258,482 | 3/1981 | Strock | 5/432 X |
| 3,143,748 | 8/1964 | Manning | 5/420 |
| 3,336,610 | 8/1967 | Geddings | 5/420 |
| 4,190,918 | 3/1980 | Harvell | 5/465 |
| 4,441,271 | 4/1984 | Hutchinson | 5/437 X |

*Primary Examiner*—Alexander Grosz
*Assistant Examiner*—Michael J. Milano
*Attorney, Agent, or Firm*—Lloyd L. Zickert

[57] ABSTRACT

A dual, two-person bench (stadium) seat case, essentially of three pieces of fabric sewn together to afford a pair of pockets, facing one another, into which seat cushions are readily insertable and removable; flaps overlap at the open ends of the pockets to protect the interior, the case folds about an integral gusset of fabric between the pockets.

9 Claims, 1 Drawing Sheet

TWO PERSON SEAT CASE

BRIEF SUMMARY OF THE INVENTION

This invention relates to a two-person seat case, containing soft pads or cushions, which may be used for stadium events, picnics and so on where a hard seat such as a bench or other long, hard uncomfortable seating is normally present. The seat case, opened, is used by two persons sitting side by side, next to one another.

The objects of the invention are to construct a neat compact arrangement of two pads or cushions, inside respective pockets, the pockets being joined by a gusset or strap section, allowing the two seat combination to be neatly folded thereabout for carrying; to assure the two seats are coupled when folded so that the seat surfaces will be protected against inclement weather and maintained clean; to allow the pads to be removed from their respective pockets for different purposes; and to provide assurance the cushions or pads will stay in place.

DETAILED DESCRIPTION

Figure 1:
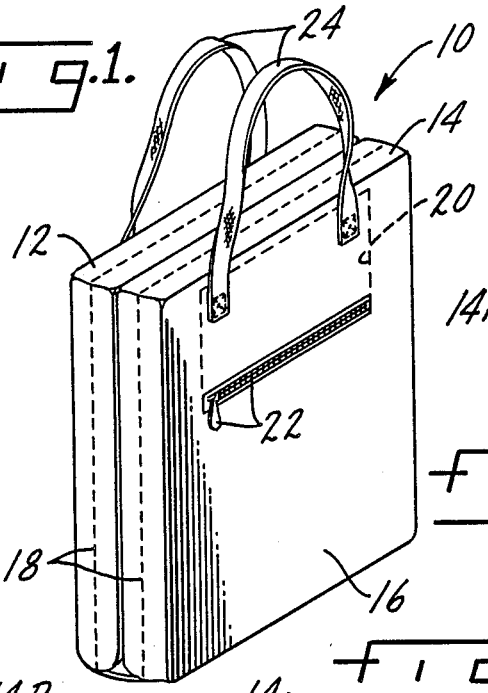
FIG. 1 is a perspective view of the seat case, folded and secured for carrying.

The two-person seat case characterizing the present invention is identified by reference character 10 in FIG. 1. It comprises two separate pockets 12 and 14 afforded by sturdy fabric, such as nylon. As will be described in more detail, each of the pockets has a closed end, two closed sides and an open end.

Figure 2:
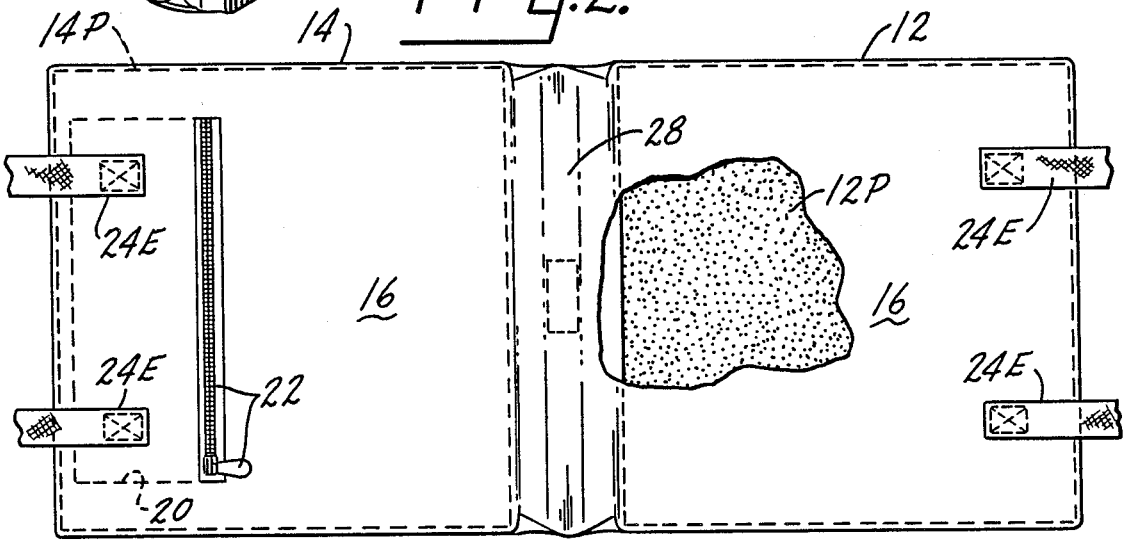
FIG. 2 is a bottom plan view of the seat case, unfolded.
Figure 3:
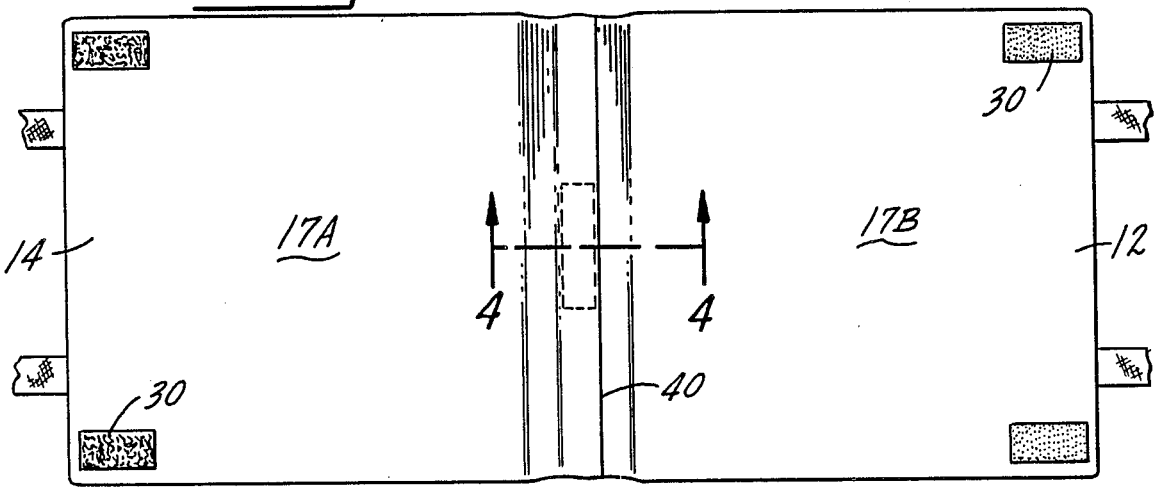
FIG. 3 is a top plan view of the seat case, unfolded.

FIGS. 2 and 3 are respectively plan views at the bottom of the seat case and at the top of the case, when unfolded. The case structure includes a bottom stretch of fabric, such as nylon, identified by reference character 16 in FIG. 2.

The pockets are on the opposite side, FIG. 3, and are afforded by two separate pieces of fabric 17A,17B, joined (sewn) to the bottom stretch of fabric by stitching 18, FIG. 1, which need not be described in detail.

Advantageously, the bottom of the case may include a small utility pouch 20 having a zipper closure 22. When the case is folded, the zipper pouch 20 is on the outside of the case as can be seen in FIG. 1. Also, as shown in FIGS. 1 and 2, flexible carrying straps 24 of loop form have their free ends 24E, FIG. 2, stitched to the end portions of the bottom stretch of fabric cover material.

Figure 4:
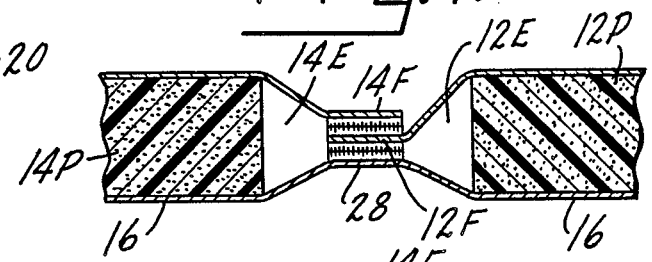
FIG. 4 is a fragmentary detail section, enlarged, substantially on the line 4—4 of FIG. 3.

The continuous bottom stretch of the cover fabric, FIG. 2, includes an intermediate gusset portion 28 located medially between the two pockets 12 and 14 into which two cushion pads 12P and 14P are inserted. The two cushion pads 12P and 14P, FIG. 4, are of a soft pliable comfortable material such as foam plastic. The cushion or seat assembly is folded and unfolded about the gusset portion 28.

Referring to FIG. 3, this shows the opposite side or top of the cushion assembly, as it would be spread in the open position on a bench. When the case is folded, it will be folded inwardly toward the observer, FIG. 3, and in this connection pressure activated fasteners 30 (e.g., VELCRO type hook and loop fasteners) and preferably located at the four outer corners so that when the two pockets are folded inwardly against one another they are at the same time effectively connected to keep the inside of the seat clean and to protect the faces of the seat against inclement weather.

It has been mentioned above that the pockets 12 and 14 have open ends, otherwise being closed by the stitching on the remaining three sides. Thus, as shown in FIG. 4, pocket 12 has an openable end 12E and pocket 14 has an openable end 14E. The inside or seating face of pocket 12 includes a flap 12F, FIG. 5. Likewise, the interior or seating face of pocket 14 has a closure flap 14F, and this flap normally overlies closure flap 12F. The opposed faces of the two closure flaps 12F and 14F are respectively provided with pressure activatable fasteners of the kind described above, respectively identified by reference characters 32 and 34.

The inside face of the gusset 28 includes a similar pressure activatable fastener 36 and the underside of closure flap 12F is provided with a like fastener 38.

Figure 5:
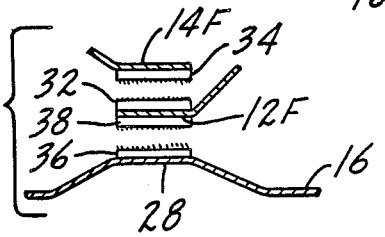
FIG. 5 is a detail similar to FIG. 4, with the parts unfastened.

In normal use, with the cushions or pads in the unfolded state, FIG. 3, the fasteners associated with the gusset 28 are all tightly adhered, FIG. 4, but of course may be easily released manually, FIG. 5. Other kinds of fasteners could be used, such as fixed snap fasteners but the VELCRO-type hook and loop fastener is preferred not only because of easy use, but also because of cost of construction. Another, and most distinct advantage, is that the closure flaps at the open ends of the pockets may be easily tensioned or stretched tightly across one another to assure a relatively tight and weather-secure closure seam 40, FIG. 3, and which also keeps the interior clean.

In any event, the construction in and at the gusset area 28 allows both pockets to be readily opened and the pads removed and replaced after long use, foam plastic being readily available.

The position of the utility pouch, adjacent one of the handles, that is, being positioned at one of the outer ends of one of the cushion pockets, is of significance in that the pouch is readily accessible to a person on the seat, who simply leans to one side away from the pouch to gain access thereto. Clearly, the seat case could be constructed with a second pouch.

All of the VELCRO type fasteners are of generous area so that even though alignment is not even, the fasteners nonetheless will contact one another to serve the purposes mentioned.

It will be understood that modifications and variations may be effected without departing from the scope of the novel concepts of the present invention, but it is understood that this application is to be limited only by the scope of the appended claims.

I claim:

1. A two-person seat case having two pockets each with a soft cushion pad inserted therein and comprising:

a fabric cover constructed to define the two pockets, each pocket having a closed outer end, a pair of closed sides and an open inner end, the open inner ends facing one another;

the cover including an outer stretch of fabric having a gusset portion between the pockets medially of the open ends of the pockets;

each pocket at the open end having a closure flap overlying the gusset portion, one of the flaps overlying the other;

the inside face of the gusset and each closure flap having a pressure activatable and manually releasable fastener secured thereto whereby the two closure flaps may be releasably fastened to one another and the two then fastened to the gusset portion;

whereby the seat case may be folded and unfolded about the gusset and the cushion pads secured within the pockets may be displaced by releasing the fasteners.

2. A seat case according to claim 1 wherein the cover is of three pieces of fabric, the bottom stretch and its gusset being one piece, and two pocket pieces, with their closure flaps, sewn thereto.

3. A seat case according to claim 2 in which handle straps and a utility pouch are sewn to the outer stretch of the cover.

4. A seat case according to claim 1 in which the pockets are completed by respective pocket pieces of fabric sewn to one side of the outer stretch of fabric, in which handle straps having hand loops are sewn to the ends of the outer stretch of fabric, outward of the gusset portion, in which a utility pouch, accessible from the outside of the seat, is sewn to the inside face of the outer stretch of fabric adjacent one of the handle straps, and in which pressure activable, manually releasable fasteners are secured to the pocket pieces of fabric to securely hold the case together when the pockets are folded inwardly and nested one against the other.

5. A seat case according to claim 1 wherein the fasteners are VELCRO hook-and-loop fasteners of generous area so that the closure flaps may be tensioned and tugged to generously overlap one another and then fastened together to afford a tight medial seam between the seat cushions.

6. A seat case according to claim 5 in which the pockets are completed by respective fabric pocket pieces sewn to one side of said outer stretch of fabric, and wherein there are pairs of VELCRO hook-and-loop pocket-located fasteners of generous area opposed to one another at complemental positions on the fabric pocket pieces to hold the seat case together when folded even though folded offcenter.

7. A seat case according to claim 6 wherein the pocket-located fasteners are at the outer corners of each fabric pocket piece.

8. A seat case according to claim 1 wherein a utility pouch is sewn to one end of the outer stretch of fabric, said pouch thereby being easily accessible to a person leaning away from the pouch to reach thereinto, and closure means for said pouch.

9. A seat case according to claim 7 wherein a utility pouch is sewn to one end of the outer stretch of fabric, said pouch thereby being easily accessible to a person leaning away from the pouch to reach thereinto, and closure means for said pouch.

* * * * *